United States Patent [19]

Petrosky

[11] Patent Number: 4,982,950

[45] Date of Patent: Jan. 8, 1991

[54] ROTATABLE EXERCISE DEVICE

[76] Inventor: Charles Petrosky, 1118 N. Jefferson St., Arlington, Va. 22205

[21] Appl. No.: 256,757

[22] Filed: Oct. 12, 1988

[51] Int. Cl.[5] ..... A63B 5/00

[52] U.S. Cl. ..... 272/67; 272/68

[58] Field of Search ..... 272/67, 128, 93, 116, 272/122, 132; 128/25 R; 446/266, 242, 265

[56] References Cited

U.S. PATENT DOCUMENTS

| | | | |
|---|---|---|---|
| 1,764,982 | 6/1930 | Reich et al. | 446/265 |
| 2,991,585 | 7/1961 | Drees | 446/266 |
| 3,037,322 | 6/1962 | Baumgartner, Jr. | 446/242 |
| 3,162,975 | 12/1964 | Amato | 446/265 |
| 4,627,618 | 12/1986 | Schwartz | 272/122 |
| 4,693,469 | 9/1987 | Cedar | 272/128 X |
| 4,787,623 | 11/1988 | Cedar | 272/128 X |

FOREIGN PATENT DOCUMENTS

| | | | |
|---|---|---|---|
| 2523691 | 9/1983 | France | 446/242 |

*Primary Examiner*—Robert Bahr
*Assistant Examiner*—D. F. Crosby
*Attorney, Agent, or Firm*—James Creighton Wray

[57] ABSTRACT

An arm, wrist, shoulder and chest exerciser which allows maximum movement for those areas being exercised. A hand-held tube has an inner, rotatable axle. This axle attaches to another tubular structure at the top of the hand-held tube and allows this structure to rotate with a repetitive movement of the hand or arm.

3 Claims, 2 Drawing Sheets

FIG. 1
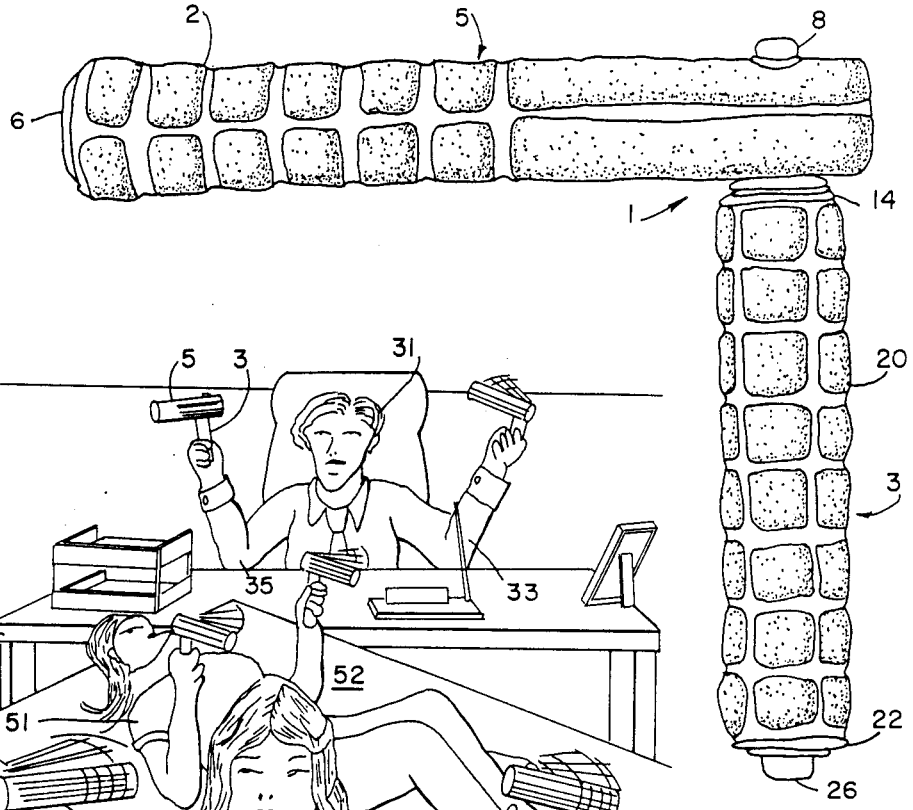
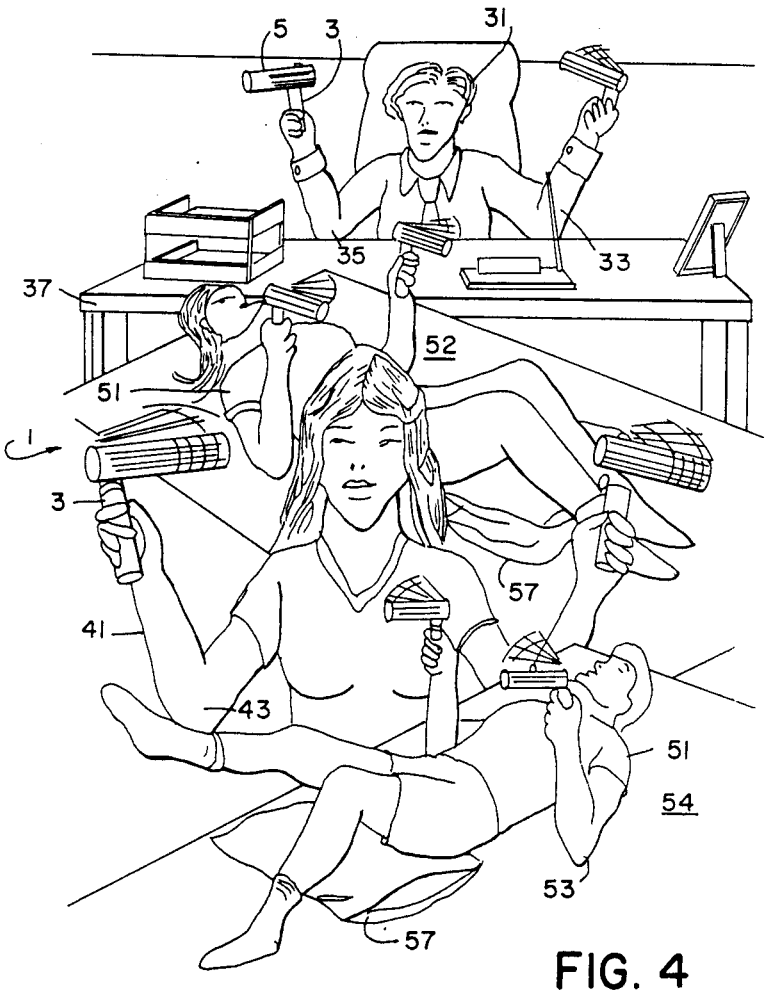
FIG. 4

ROTATABLE EXERCISE DEVICE

BACKGROUND OF THE INVENTION

This invention generally relates to exercising devices for hands, arms, wrists, shoulders and back and chest muscles. This exerciser requires the use of only one arm. This is its advantage over the prior art.

In today's fast-moving world, tight schedules sometimes come into conflict with time normally allotted for exercise. Therefore, a need exists for the ability to exercise and attend to other duties at the same time.

The prior art that exercises arms, wrists, shoulders and chests, and relates to hand-held apparatus all require two hands to operate. Three patents illustrate this point. U.S. Pat. No. 4,203,591 issued to Gibson shows an apparatus that is to be grabbed with both hands, each on a respective hand grip. The device is actuated by twisting the wrists either forward or backward to cause the apparatus to twist in a similar direction. The feat is made harder by knobs which tighten friction in the hand grips. Anderson U.S. Pat. No. 3,029,076 requires manipulating two handles against spring pressure until a cap snaps into a bore. U.S. Pat. No. 4,664,370 issued to Finch shows two parallel hand grips transversed by a bar. Grabbing the grips with one's hand, the grips are rotated in a clockwise or counterclockwise manner with respect to the bar for therapeutic or exercising use. As stated above, all require the use of two hands to utilize the invention.

U.S. Pat. Nos. East 3,550,312, Kanbar 3,533,185 and Mack 3,672,093 have whirling weights on the ends of handles. However, none is made of a simple-to-operate, rugged construction, which encourages repeated use for muscle conditioning.

The present invention requires only one hand and a simple motion with one hand, thus leaving a free hand and mind for other tasks which need attending to.

SUMMARY OF THE INVENTION

An object of the present invention is to provide a safe, simple, effective and nondistractive method and apparatus for exercising upper body muscles, tendons and joints, arms, wrists, shoulders, chest and back. This is effected in the present invention by providing two tubular structures and a solid cylindrical bar through a shorter tubular structure which is secured to a perpendicular longer tubular structure. Preferably, the bar rotates with the rotatable tubular structure. The exerciser is manipulated through a repetitive hand, wrist or arm motion while holding the shorter tubular section, in which the solid cylindrical bar connector rotates. This movement causes the rotatable tubular structure to begin to rotate, along with the attached connector bar which extends through the hand grip. The rotation of the upper tubular structure around the axis of the shorter tubular structure is the immediate object of the exercising apparatus. The motion exercises the wrist, arms, shoulder, back and chest but is nondistractive and requires only one hand to operate. If desired, a pair of these devices can be employed at the same time to exercise both arms, wrists, shoulders and respective sides of the upper torso. Various muscle groups may be exercised by intentionally focusing movements in one muscle group or another.

In the preferred embodiment, a hand-held, rotatable arm, wrist and shoulder exerciser comprises two tubular structures a connection means for connecting the tubular structures in a manner that allows a second tubular structure to rotate upon a first tubular structure. The tubular structures are preferably covered with cushioned sheaths, and connection is provided wit washers for smooth rotation of the second structure on the structure. The connection means further comprises a cylprotrusion from the top of the first tubular structure upward a manner to provide an axle-like apparatus upon which the tubular structure is rotatably mounted.

In the exerciser of the preferred embodiment, the first second tubular structures are preferably hollow tubes. It is preferred that the second hollow tube is rotatably mounted and at a 90 degree angle with respect to the first hollow The hollow tubes could be made of hollow plastic, metal or similar materials. The rotatably mounted second hollow tube preferably longer than said first hollow tube.

It is preferable that the cylindrical protrusion from the first tubular structure acts as an axle for the rotatably second tubular structure. This cylindrical protrusion comprises a solid cylindrical pipe of a length longer than the first tubular structure by a margin longer than a cross section of the second tubular structure.

The connection means between the first and second tubes preferably comprises the second tubular structure being rotatably connected to the first shorter tubular structure by passing a solid cylindrical bar through the first shorter tubular structure, into a first hole drilled near one end of the second longer tubular structure, out of a second hole in the second longer tubular structure drilled on the tube opposite of the first hole.

The solid cylindrical bar preferably has a first end portion protruding from the initial entrance point of the shorter tube and a second end portion protruding out of the side of the longer tube. Preferably, the plural locking caps fit over the protruding ends of the solid cylindrical bar and hold the longer rotatable tubular structure at a 90 degree angle to the shorter tubular structure.

The washers and spacers are preferably positioned on the bar between the first and second structures to enhance rotatability of the longer tubular structure on the first shorter tubular structure. The spacers prevent lateral movement of shorter tubular structure on the solid cylindrical bar. They are preferably placed on the bar at the bottom and the top of the shorter tubular structure. The washers are preferably placed in two sets of twos; one set between the bottom locking cap and the bottom spacer, and the other set placed between the top spacer and the bottom insertion point of the bar into the longer tubular structure. The washers provide friction-reducing rubbing surfaces for the rotatable longer tubular structure.

In the preferred embodiment, the method of exercising arms, wrists, shoulders and chest muscles comprises holding the handgrip of a hand-held rotatable apparatus and rotating the grip either clockwise or counterclockwise to initiate the circular movement of the rotatable tubular structure in a corresponding direction.

These and other and further objects and features of the invention are apparent in the disclosure which includes the above and ongoing specification with the claims and the drawings.

BRIEF DESCRIPTION OF THE DRAWINGS

FIG. 1 is an elevational side view of the assembled exercising device.

FIG. 4 shows various exercises using the new invention.

DETAILED DESCRIPTION OF THE PREFERRED EMBODIMENT

Figures 2, 3:
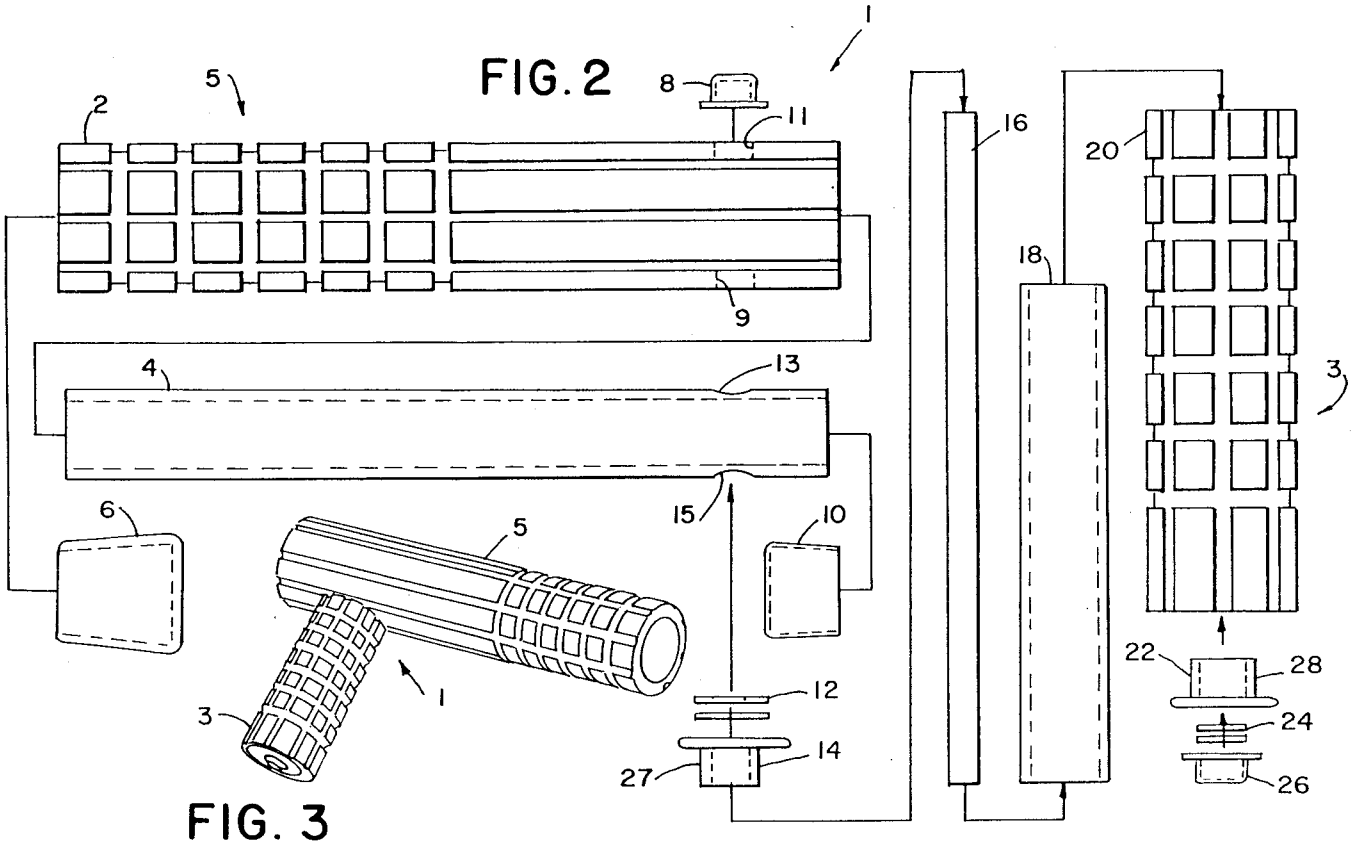
FIG. 2 is an unassembled view of the exercising device with arrows included to show the separate components and their respective places.
FIG. 3 is an isometric view of the assembled apparatus.

In the preferred invention, two rigid tubular structures of differing sizes are connected in such a fashion that repeated movement of the smaller tubular structure will, through its connection at its top to one end of the longer tubular structure, cause the longer tubular structure to circle around an axis through the shorter tubular structure. The circular motion required to create such an action exercises the hand, wrist, arm, shoulder, back and chest.

A detailed description is provided with reference to the drawings. FIG. 1 is a front elevational view of the apparatus in working order. FIG. 2 shows the various components of the apparatus in disassemblement and arrows show how the components fit together.

The exercising device 1 has a hand-held tubular structure 3 on which a rotating tubular structure 5 is mounted. Rotating tubular structure 5 has a tubular foam cover 2, which fits lightly on tube 4. End caps 6 and 10 are press fit on ends of tube 4 beneath cover 2. Cap nut 8 grips an upper end of bar 16 after it passes through bushing 14, washers 12 and holes 9, 15, 13 and 11, respectively, in the rotating tubular structure 5.

Bar 16 passes through tube 18, which is covered by hand grip cover 20 forming hand-held tubular structure 3. Bushing 22 and washers 24 are slid over an end of bar 16. Cap nut 26 is pushed and locked on the end of bar 16. Tubular portions 27 and 28 of bushings 14 and 22 fit between an inside of tube 18 and bar 16.

Tubular structure 18 serves as the hand piece and actuator of the exercising apparatus. The tubular structure, hand piece 18 and rotatable tube 4 are preferably made of ¾ inch PVC tubing. Hand piece 18 slides over solid cylindrical bar 16, which is preferably made of a solid metal rod, but other rigid materials would suffice. Spacer bushings 14 and 22 fit on solid cylindrical bar 16 at points above and below hand piece 18 with their cylindrical portions fitting inward in the hollow, tubular structure of hand piece 18, holding bar 16 centrally positioned within tubular hand piece 18 while allowing the bar 16 to rotate freely within tubular hand piece 18. Friction reducing washers 12 and 22 slide onto bar 16 at points above and below spacer bushing support structures 14 and 22. The washers 12 and 24 are preferably made of metal and are positioned on the bar 16 in pairs. When rotatable tubular structure 5 and bar 16 rotate, with bar 16 rotating within tubular hand piece 18, the washers 12 and 24 reduce friction.

A locking cap nut 26 clamps onto the bottom tip of bar 16 protruding from the bottom of tubular structure 18 through spacer 22 and washers 24. Hand grip sleeve 20, preferably made of a spongy rubber, such as a bicycle hand grip, slides tightly over tubular hand piece 18. Rotatable structure sleeve 2, also preferably made of a spongy rubber material, slides tightly over rotatable tube 4. The top of cylindrical bar 16, extending out of tubular hand piece 18 and through spacer 14 and washers 12, slides through corresponding groups of holes, 11 and 13, 9 and 15, respectively, on the proximal end of rotatable tube 4 and sleeve 2. Locking cap nut 8 clamps on the top end of bar 16 protruding from hole 11 in sleeve 2. Rubber cap 6 fits on the distal end of rotatable tube 4 underneath sleeve 2. Stopper 10 fits on the proximal end of rotatable tube 4 underneath sleeve 2.

FIG. 3 is a perspective view of the assembled exercising apparatus.

The invention is directed to light, rapidly repetitive exercise to promote muscular and vascular development and circulation.

The present invention is preferably used in pairs. Gripping and squeezing the hand grips repeatedly exercises the fingers, tendons and forearm muscles. Repeatedly twirling the rotating tubes with elbows supported on a surface exercises upper arm muscles, as well. Holding arms unsupported and especially extended outward further exercises back and chest muscles. Immediate results are noted by warming feeling in the involved muscles. The exercise device has been acclaimed by testers as useful in body and breast shaping and in promoting strengthening and reducing soreness of muscles, ligaments and tendons having particular relation to sports activities such as tennis. Forearms and elbows particularly benefit from use of the invention.

FIG. 4 shows varied uses of the invention.

In FIG. 4 a office worker 31 supports one elbow 33 suspended and rests another elbow 35 on a desk 37 while gripping handles 3 and twirling the rotating tubes 5. Reversing elbows exercises all upper body and arm muscle groups.

In FIG. 4 a person 41 stands and twirls the rotating tubes while holding elbows 43 outward from the body in a flexed condition to exercise all torso and arm muscles. Moving elbows 43 to different positions while twirling the exercise devices 1 and squeezing handles 3 further concentrates the light work out. Extending arms to full outward position increases the desirable rhythmic muscular stress.

FIG. 4 further shows persons 51 resting in prone position on a bed 52 and floor 54 with elbows 53 spaced outward from a stomach. A leg 55 is moved concurrently with the twirling of the exercise devices 1, to increase exercise. One or more pillows 57 are recommended to keep knees raised when legs are at rest for purposes of proper back support and extension. Raising and repositioning elbows 53 further aids the exercise.

While the present invention is basic in construction, its simplicity is its utility. Its simple construction provides a sturdy exerciser of the hand, wrist, arms, shoulders, back and chest that is safe, does not take an inordinate amount of time to master, and is healthful.

While the invention has been described with reference to specific embodiments, modifications and variations of the invention may be made without departing from the scope of the invention which is defined in the following claims.

I claim:

1. A method of exercising arms, wrist, shoulders and chest muscles comprising holding a first cushioned tubular handgrip of hand-held rotatable apparatus and rotating the handgrip either clockwise or counterclockwise to initiate circular movement of a second cushioned rotatable tubular structure in a corresponding direction and rotating of a bar passing axially through the first cushioned tubular handgrip and passing radially through the second cushioned rotatable tubular structure, rhythmically moving the hand-held apparatus and rotating the bar in the tubular handgrip and rotating the second horizontal tubular structure by centrifugal force above an upper end of a first cushioned tubular handgrip, further comprising rotating the rod within the tubular hand grip.

2. A hand-held rotatable arm, wrist and shoulder exerciser comprising two tubular structures, a rotating connection means for connecting the tubular structures in a manner that allows said second tubular structure and the connection means to rotate upon and in respectively, said first tubular structure, said tubular structures covered with cushioned sheaths, said connection provided with washers disposed between the structures for smooth rotation of said second structure on said first structure, and said rotating connection means further comprising a cylindrical protrusion extending upward from the top of said first tubular structure in a manner to provide an axle-like apparatus upon which said second tubular structure is rotatably mounted, wherein the connection means further comprises the second tubular structure being rotatably connected to the first shorted tubular structure by passing a solid cylindrical bar through the first shorter tubular structure, into a first hole drilled near one end of the second longer tubular structure, out of a second hole in the second longer tubular structure drilled on the tube diametrically opposite the first hole, said solid cylindrical bar having a first end portion protruding from the bottom axial end of the shorter tube and a second end portion protruding out of the side of the longer tube, wherein the connection means rotatably slides within the first tubular structure.

3. A hand-held, rotatable arm, wrist and shoulder exerciser comprising two tubular structures having cylindrical walls, an axle extending longitudinally through the first tubular structure and diametrically through the cylindrical wall of the second tubular structure and rotating freely in the first tubular structure and connecting the tubular structures in a manner that allows said cylindrical wall of second tubular structure to rotate upon an axial end of said first tubular structure, both of said tubular structures covered from end to end with cushioned sheaths, said axle provided with washers between an axial end of the first tubular structure and a wall of the second tubular structure for smooth rotation of said second structure on said first structure, and said axle further comprising a cylindrical protrusion extending upwards from said first tubular structure and providing a mounting for the cylindrical wall of said second tubular structure, wherein the tubular structures further comprise first and second hollow tubes, wherein said second hollow tube is rotatably mounted above an at a 90 degree angle with respect to said first hollow tube, said hollow tubes being made of hollow plastic tubing, said rotatably mounted second hollow tube being longer than said first hollow tube, wherein an extension of the axle from said first tubular structure acts as an axle for rotatably mounting the second tubular structure, the axle comprising a solid cylindrical rod of a length longer than said fist tubular structure to an extend which is slightly longer than a diameter of said second tubular structure, wherein an inner surface of an entire length of the first tubular structure slides over the rod.

* * * * *